US009833800B2

(12) United States Patent
Ray

(10) Patent No.: US 9,833,800 B2
(45) Date of Patent: Dec. 5, 2017

(54) VENTED PUMP

(71) Applicant: GOJO Industries, Inc., Akron, OH (US)

(72) Inventor: Eugene W. Ray, Barberton, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

(21) Appl. No.: 14/996,319

(22) Filed: Jan. 15, 2016

(65) Prior Publication Data

US 2016/0214126 A1 Jul. 28, 2016

Related U.S. Application Data

(60) Provisional application No. 62/106,375, filed on Jan. 22, 2015.

(51) Int. Cl.

| | |
|---|---|
| ***B65D 37/00*** | (2006.01) |
| ***B05B 11/00*** | (2006.01) |
| ***F04B 9/14*** | (2006.01) |
| ***F04B 13/00*** | (2006.01) |

(52) U.S. Cl.

CPC ..... *B05B 11/30* (2013.01); *B05B 11/0016* (2013.01); *F04B 9/14* (2013.01); *F04B 13/00* (2013.01)

(58) Field of Classification Search

CPC ..... B05B 11/30; B05B 11/0016; F04B 9/14; F04B 13/00

USPC ..... 222/207

See application file for complete search history.

(56) References Cited

U.S. PATENT DOCUMENTS

| | | | | | |
|---|---|---|---|---|---|
| 2,814,419 | A * | 11/1957 | Lipman | B05B 11/3032 | 222/207 |
| 3,486,663 | A * | 12/1969 | Humphrey | B05B 11/3032 | 222/207 |
| 3,507,586 | A * | 4/1970 | Kutik | B05B 11/3032 | 137/855 |
| 3,726,442 | A * | 4/1973 | Davidson | B05B 11/0016 | 220/231 |
| 3,752,366 | A * | 8/1973 | Lawrence, Jr. | B05B 1/3431 | 222/207 |
| 3,820,689 | A * | 6/1974 | Cocita | B05B 11/3032 | 222/207 |
| 3,987,938 | A | 10/1976 | Cooprider et al. | | 222/209 |

(Continued)

FOREIGN PATENT DOCUMENTS

| | | | |
|---|---|---|---|
| GB | 2 069 625 | 8/1981 | F04B 21/00 |

OTHER PUBLICATIONS

International Search Report dated May 6, 2016 in related application No. PCT/US2016/013521.

(Continued)

*Primary Examiner* — Patrick M Buechner
*Assistant Examiner* — Michael J Melaragno
(74) *Attorney, Agent, or Firm* — Calfee, Halter & Griswold LLP

(57) ABSTRACT

A vented pump includes a pump housing with a fluid retention cavity, a fluid inlet, and at least one vent opening therethrough. A pump dome is secured to the pump housing to form a dome cavity. Movement of the pump dome allows material from the fluid retention cavity to enter the dome cavity through the fluid inlet, and selectively allows ambient air to enter the fluid retention cavity through the at least one vent opening.

20 Claims, 4 Drawing Sheets

(56) References Cited

U.S. PATENT DOCUMENTS 4,564,130 A * 1/1986 Eulenburg ..... B05B 11/0048 222/207
5,099,885 A * 3/1992 Nilsson ..... B05B 11/3032 137/852
5,176,510 A * 1/1993 Nilsson ..... B05B 11/3032 222/207
5,271,432 A * 12/1993 Gueret ..... B05B 11/0043 137/854
5,465,872 A * 11/1995 Gueret ..... B05B 11/0005 222/105
5,505,341 A * 4/1996 Gueret ..... B05B 11/3033 222/207
5,518,147 A * 5/1996 Peterson ..... B05B 11/3035 222/153.07
5,544,789 A * 8/1996 Gillingham ..... B05B 11/306 222/153.13
5,664,703 A 9/1997 Reifenberger et al. ..... 222/207
6,216,916 B1 4/2001 Maddox et al. ..... 222/105
6,619,512 B1 * 9/2003 Sayers ..... A47K 5/1207 222/181.3
6,726,064 B2 4/2004 Bonningue ..... 222/321.9
7,891,583 B2 2/2011 Sayers et al. ..... 239/327
7,997,454 B2 * 8/2011 LaFlamme ..... A45D 34/04 222/207
2007/0164052 A1 * 7/2007 Julian Pidevall ..... B05B 11/306 222/207
2009/0302064 A1 * 12/2009 Lavabre ..... B05B 11/0018 222/207
2010/0084432 A1 * 4/2010 Pelfrey ..... A45D 34/04 222/153.13
2010/0219207 A1 * 9/2010 Canfield ..... B05B 11/0016 222/207
2013/0262345 A1 10/2013 Ciavarella et al. ..... 705/500
2016/0214126 A1 * 7/2016 Ray ..... B05B 11/30

OTHER PUBLICATIONS

Written Opinion dated May 6, 2016 in related application No. PCT/US2016/013521.

* cited by examiner

VENTED PUMP

CROSS-REFERENCE TO RELATED APPLICATIONS

This application claims priority of U.S. Provisional Application Ser. No. 62/106,375 filed Jan. 22, 2015, and which is incorporated herein by reference.

TECHNICAL FIELD

The present invention is generally related to pumps used with fluid dispensers. Specifically, the present invention is related to fluid dispensers with a pump dome valve which is of at least a two-piece construction that provides a vent.

BACKGROUND ART

Dispensers that utilize a pump dome valve are primarily configured to be used with collapsible containers. As is well understood in the art, a pump dome valve provides an elastomeric or flexible plastic material that is shaped as a pump dome that forms a pump dome cavity within the pump dome. When the pump dome is depressed a quantity of fluid material is dispensed. In other words, as the flexible material is depressed or actuated, the fluid material that is contained within the pump dome cavity is dispensed and as the pump dome is released and returns to its original shape, the suction forces generated by the pump dome draw the material from within the container into the pump dome cavity for the next actuation of the pump dome. Such pump dome valves are used with containers that have a collapsible structure such as a plastic bag. As the pump dome is repeatedly actuated and fluid material is drawn from the container into the pump dome cavity, the build-up of vacuum forces causes the container to collapse. Since the container is collapsible, the vacuum forces generated do not hinder the dispensing of material. However, such pump dome valves are problematic in that they require many component pieces to construct the valve. These component pieces may include spring-loaded check valves, specially oriented fittings, and a retaining ring to hold the pump dome. These pieces are costly and allow for more mechanical interconnections to fail, thus rendering the pump dome valve inoperative. Moreover, such valves cannot be used on non-collapsible/rigid refill containers, as the vacuum forces within the container cannot be overcome to allow for the material to be dispensed.

One solution for overcoming the inability to use a pump dome valve with non-collapsible refill containers is to allow for a separate venting feature to be associated with the refill container. As such, when a vacuum develops within the rigid refill container, the vacuum force pulls in ambient air through a vent in the refill container, not the pump dome valve, thus allowing air to enter the refill container and relieve the vacuum forces. As a result, the fluid material may continue to be dispensed upon actuation of the pump dome valve. However, such a configuration still requires a vented container or valve and the problematic features of the aforementioned pump dome valves.

Accordingly, there is a need in the art for a simplified pump dome valve structure which allows for venting of the pump dome valve so as to eliminate the multiple pieces/parts of the prior art valve constructions, eliminate the separate venting of the rigid refill container, and to reduce the number of mechanical interconnections required for the valve.

SUMMARY OF THE INVENTION

In light of the foregoing, it is a first aspect of the present invention to provide a vented pump.

It is another aspect of the present invention to provide a vented pump comprising a pump housing having a fluid retention cavity, the pump housing having a fluid inlet therethrough and at least one vent opening therethrough, and a pump dome secured to the pump housing and together forming a dome cavity, wherein movement of the pump dome allows material from the fluid retention cavity to enter the dome cavity through the fluid inlet, and selectively allows ambient air to enter the fluid retention cavity through the at least one vent opening.

It is yet another aspect of the present invention to provide a vented pump used with a container, comprising a fluid container and a vented pump coupled to the fluid container, the vented pump comprising a pump housing having a fluid retention cavity contiguous with the fluid container through a fluid inlet, the pump housing having at least one vent opening therethrough, a pump dome secured to the pump housing so as to form a pump cavity, wherein movement of the pump domes draws fluid in from the fluid container through the fluid retention cavity via the fluid inlet and selectively allows ambient air into the fluid retention cavity through the at last one vent opening.

BRIEF DESCRIPTION OF THE DRAWINGS

These and other features and advantages of the present invention will become better understood with regard to the following description, appended claims, and accompanying drawings wherein:

BEST MODE FOR CARRYING OUT THE INVENTION

Figure 1:
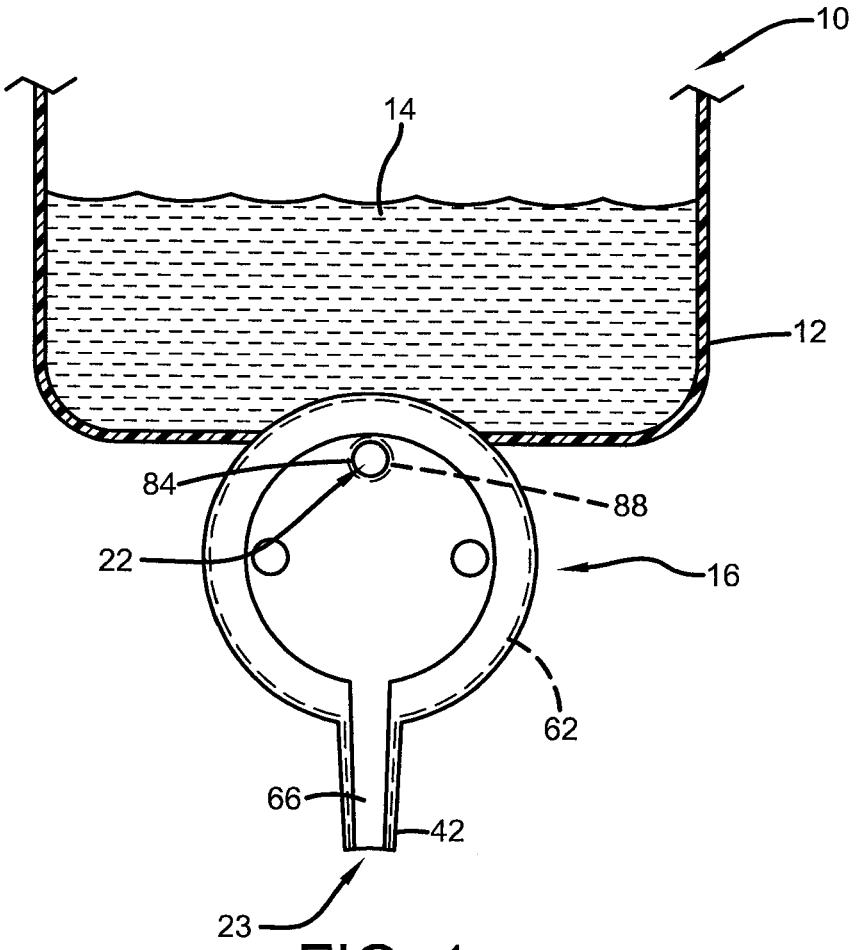
FIG. 1 is a schematic representation of a vented pump and fluid container according to the concepts of the present invention.

Referring now to FIGS. 1-4, it can be seen that a vented pump and fluid container are designated generally by the numeral 10. As best seen in FIG. 1, a container 12, which holds a fluid material 14 such as a sanitizer, soap or lotion, is shown wherein the container 12 is of a rigid, non-collapsible structure. Although the present embodiment is utilized with a non-collapsible container, skilled artisans will appreciate that the vented pump to be disclosed could also be used with a collapsible structure if desired. In any event, coupled to the container 12 is a vented pump 16 which dispenses the fluid material upon actuation.

The vented pump 16 includes a pump housing 18 which may be coupled to and associated with a pump dome 20. The pump housing 18 may be made of a rigid or semi-rigid plastic material, whereas the pump dome 20 may be constructed of a flexible, elastomeric material such as silicone rubber or thermoplastic elastomer (TPE). As shown in FIG.

1, at least one vent 22 is shown. In most embodiments, each vent 22 is maintained in a normally closed position. In one embodiment, a single vent 22 may be provided which is diametrically opposite to a pump outlet 23. Other embodiments may provide multiple vents, and it is believed that any vent 22 provided should be positioned at least 30 degrees away from the outlet. Generally, the vented pump 16 expels fluid material when the pump dome 20 is pressed, and draws in fluid material from the container when the pump dome is released so that material can be expelled upon the next pressing of the pump dome.

Figure 2:
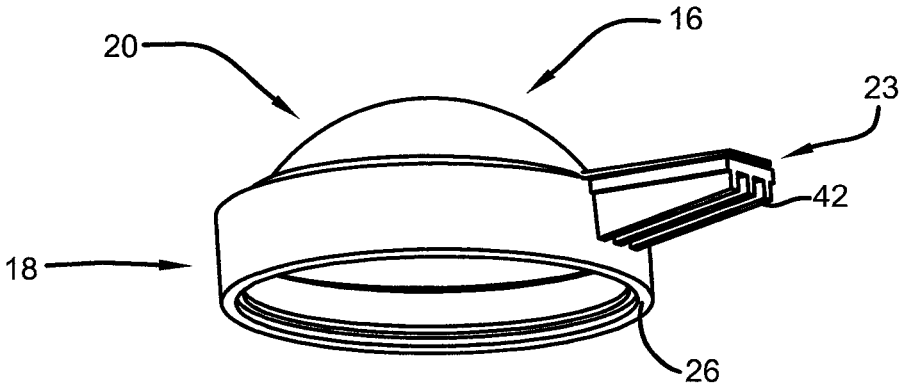
FIG. 2 is a rear perspective view of the vented pump according to the concepts of the present invention.
Figure 3:
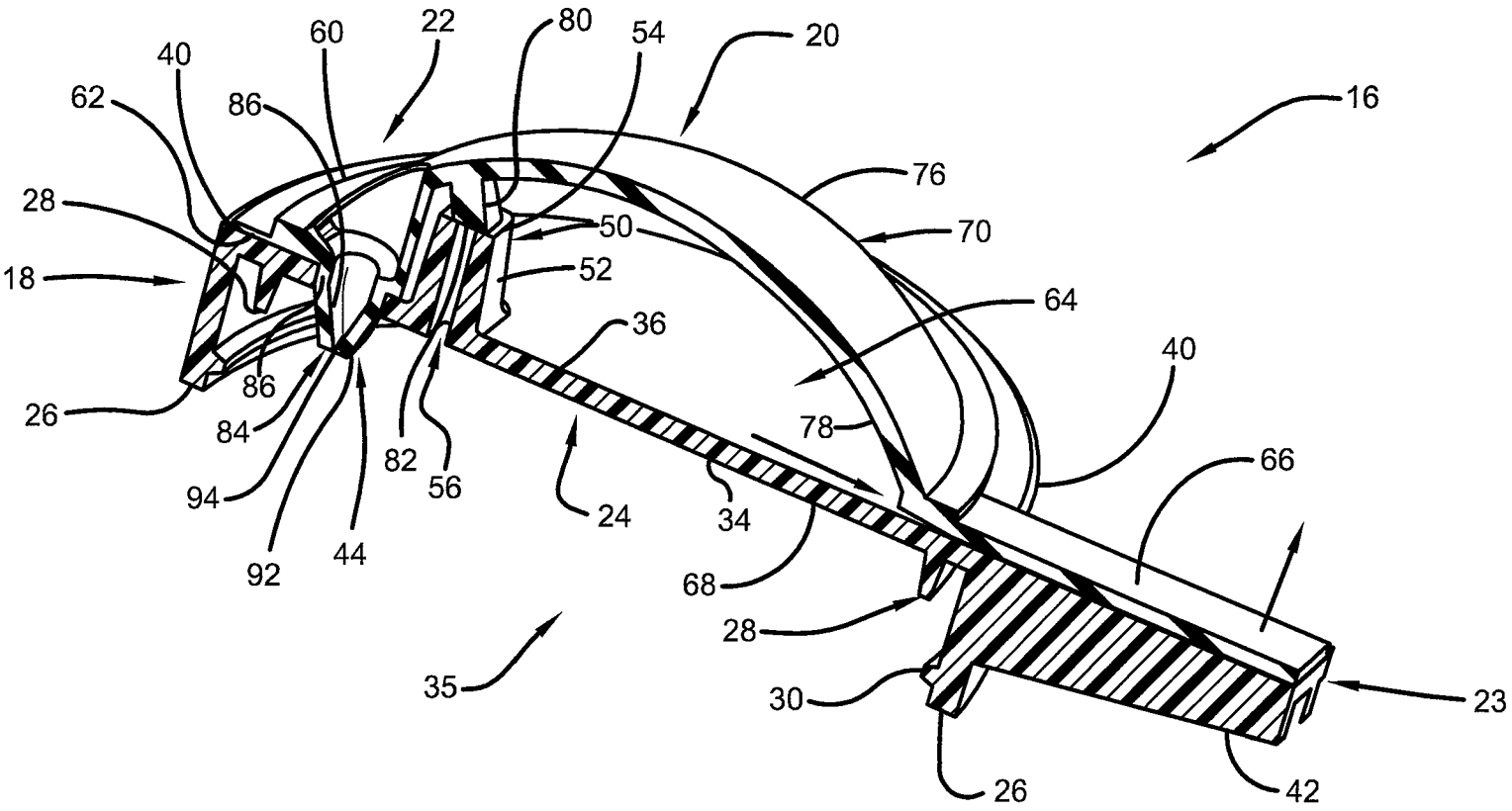
FIG. 3 is a cross-sectional perspective view of the vented pump according to the concepts of the present invention.
Figure 4:
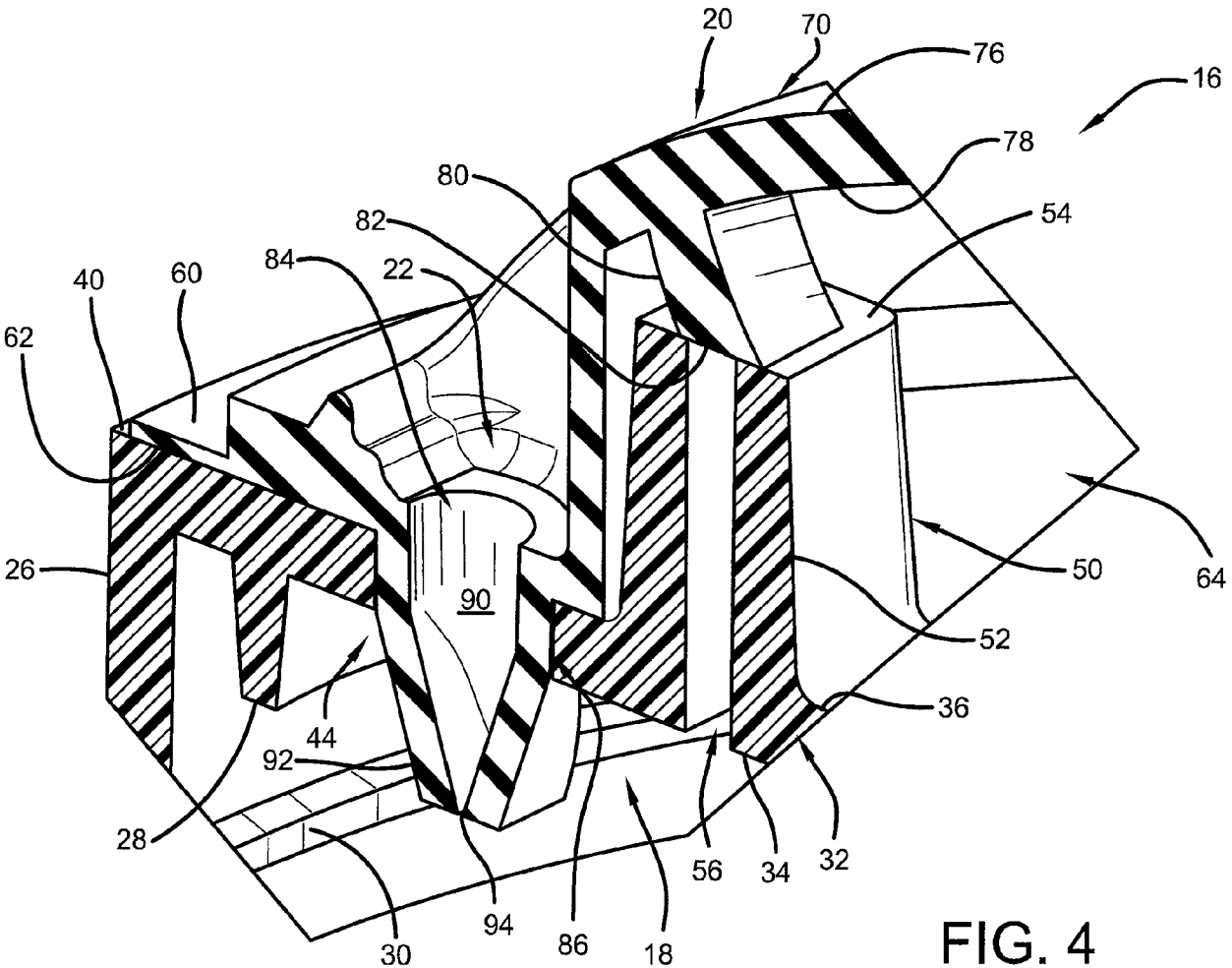
FIG. 4 is a detailed cross-sectional perspective view of the vented pump showing a dome vent and a fluid inlet which are part of the vented pump according to the concepts of the present invention.

As best seen in FIGS. 2-4, the pump housing 18 includes a pump base 24. A mounting ring 26 extends from the pump base 24 in a direction away from the pump dome 20. The mounting ring 26 may be deflectably secured to a corresponding mating fixture provided by the container 12. A sealing ring 28, which is smaller in diameter than the mounting ring 26, may extend from the pump base 24 in the same general direction as the mounting ring. A sealing rib 30 may extend substantially perpendicularly from the mounting ring 26 in a radially inward direction. The sealing ring 28 and the sealing rib 30 assist in mating the pump housing 18 to the container 12 so as to provide a fluid tight connection therebetween. In some embodiments, the sealing rib 30 and/or rib 30 or related component may provide an O-ring to ensure the fluid tight seal.

The pump base 24 provides a container surface 34 that faces inwardly toward the fluid container 12. As such, any material 14 in the fluid container may accumulate on or adjacent to the container surface 34. Skilled artisans will appreciate that the container surface 34 along with the fluid container 12 form a fluid retention cavity 35 that is contiguous with the contents of the container 14. On a side of the pump base 24 opposite the container surface 34 is a dome surface 36. The pump base 24 provides an outer periphery 40 from which radially extends a housing stem 42. Generally, the housing stem 42 may extend in a direction furthest away from the container 12. To a certain extent, it will be appreciated that gravity forces place the material adjacent the vented pump 16 and assists in transferring the material from the container to the user.

Extending through the pump base 24 is a vent hole 44 which is part of the vent 22. The vent hole 44 is radially positioned inwardly from the outer periphery 40 and, as seen in the drawings, in one embodiment is diametrically opposite the housing stem 42. The vent 22 is maintained in the vent hole 44 and the vent 22, in most embodiments, is in the form of a normally closed slit.

The pump base 24 also provides at least one fluid inlet 50. The fluid inlet 50 extends from the dome surface 36. In one embodiment, the inlet 50 may provide for a port wall 52 that extends from the surface 36 and which may be of a rectangular, round or other shape. The height of the port wall 52 may vary depending upon the configuration of the pump done 20. In some embodiments the port wall 52 may be raised only a minimal distance from the surface 36. In other embodiments, the port wall 52 may extend to be substantially adjacent an underside of the pump dome 20. The port wall 52 provides for a port surface 54 substantially perpendicular thereto. Extending through the pump base 24 and surrounded by the port wall 52 is a port 56 which provides an opening that effectively extends between the container surface 34 and the dome surface 36.

In some embodiments, the vent or vents 22 may be located away from the inlet port 56 to reduce the likelihood of accidentally dispensing vent air. As skilled artisans will appreciate, accumulation of vent air in the pump dome may reduce the amount of fluid material that can be dispensed. Accumulated vent air may also interfere with dispensing of material from the pump dome. Such an undesired event could happen if the pump dome is actuated as a bubble of vent air enters the container 12 via the fluid retention cavity 35. This undesired event can be avoided by radially positioning the inlet port 56 away from the vent(s) or by increasing the vertical distance between the vent opening and the port surface 54. In the embodiment shown, the fluid will likely accumulate toward the lower end of the fluid retention cavity near the stem 42 and away from the vent 22. In other embodiments, the pump 16 is oriented horizontally with the dome 20 facing down toward the ground. The distance between the vent 22 and its associated slit and the inlet 56, as well as the tendency for air bubbles to travel upwards at an accelerated speed due to vacuum pressure and buoyancy, are believed to be sufficient for keeping air out of the dome. If air gets into the dome, the air will rest on the plane 36 until it gets dispensed with the fluid.

The pump dome 20 is secured to the pump housing 18. As previously noted, the pump dome 20 may be configured from an elastomeric/flexible material. The pump dome 20 includes a seal periphery 60 which substantially dimensionally matches the outer periphery 40 of the pump base 24. The pump dome 20 and the pump base 24 are connected at a seal connection 62 which extends substantially around both peripheries 40 and 60. The seal connection may be a weld or may be secured by adhesives, or a combination of both. The pump dome 20 and the pump base 24 form a dome cavity 64 therebetween.

Extending from a peripheral portion of the pump dome 20 is reed valve 66 which is supported by the housing stem 42. The reed valve 66 provides a valve opening 68, which interrupts the seal connection 62. As best seen in FIG. 1, it will be appreciated that the seal connection 62 extends along the opposed edges of the stem 42 to define the valve opening 68. The valve 66 is supported by the housing stem 42 and is normally in a closed position. However, the valve opening 68 is contiguous with the dome cavity 64 valve 66 and opens when the dome 20 is depressed and the fluid contained in the cavity is dispensed through the outlet 23.

The pump dome 20 provides for a dome portion 70 which hemispherically extends from the seal periphery 60. The seal periphery 60 is an integral extension from the dome portion 70 except for the valve opening 68. In other words, the seal periphery 60 extends from an outer diameter of the dome portion 70 to the outer periphery 40. The dome portion 70 provides for an exterior surface 76 which is opposite an interior surface 78 that faces the pump base 24 and which forms the corresponding surface of the dome cavity 64.

Extending inwardly from the interior surface 78 of the dome portion 70 is a dome tab 80, which in a normal, resting condition covers the port 56. In particular, the dome tab 80 provides for a tab surface 82 which is larger than and substantially covers the port 56 and which bears against at least the port surface 54. The distance the tab 80 extends correlates to the distance the port 56 extends from the surface 36. The lengths of the tab 80 and port 56 are such that a fluid-tight seal is normally maintained between the port surface 54 and the tab surface 82.

A dome vent 84 is provided by the pump dome 20 and is associated with the vent hole 44. In the present embodiment, the dome vent 84 is radially positioned between the outer peripheries 40/60 and the dome portion 70. In one embodiment, the dome vent 84 is formed with a sleeve 86 which is sized to frictionally fit within the vent hole 44 and provide a fluid-tight seal therebetween. In other embodiments, an adhesive may be used to secure and seal a radial area around the sleeve 86 within the vent hole 44. In still another embodiment, as seen in FIG. 1, a radial area 88 around the sleeve 86 may be welded to from an air tight seal to prevent leaking or fluid collection between the elastomer material of the pump dome 16 and the polymeric material of the pump housing 18. This weld may be formed at the same time as the outer welds used to form the seal connection 62. The sleeve 86 provides for a sleeve opening 90 which terminates at a tapered end 92. As best seen in FIG. 3, the tapered end 92 extends from the dome portion into the fluid retention cavity 35. The tapered end 92 provides a vent opening 94, which may be in the form of a slit and which is normally closed but which may be opened upon generation of a suitable vacuum force within the container 12.

In operation, a user depresses the dome portion 70, which initially pushes any air within the dome cavity 64 out through the opening 68 and the outlet 23. In other words, the reed valve 66 flexes with respect to the stem 42 such that any air retained may be passed through the valve opening 68 and the outlet 23. Additionally, as the dome portion 70 is depressed, the dome tab 80 is deflected and upon relaxing of the dome portion to its normal position, the valve opening 68 closes and a vacuum force is generated so that fluid material 14 is drawn from within the retention cavity 35 through the port 56 and into the dome cavity 64. This movement of the fluid into the pump dome cavity begins to generate a vacuum pressure within the container 12 and also within the retention cavity 35. Upon the next actuation of the pump dome, the fluid material 14 within the dome cavity is expelled out the valve opening 68 and outlet 23, and more material is drawn in from the cavity 35. Eventually, after a number of actuations of the pump dome, a sufficient vacuum force is generated within the container and overcomes the forces holding the vent opening 94 in a normally closed condition which then temporarily opens. As a result, the pump dome actuation allows for ambient air to enter in through the vent opening 94. This allows the ambient air to "bubble-up" through the retention cavity 35 and into the container 12 so as to allow air to accumulate within the container and assist in forcing material from the container into the retention cavity and subsequently into the pump dome cavity.

Figure 5:
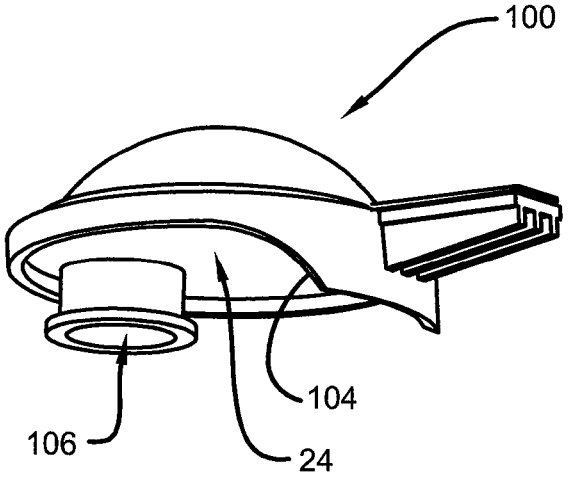
FIG. 5 is an alternative embodiment of the vented pump according to the concepts of the present invention which allows for use of a truncated mounting ring according to the concepts of the present invention.

Referring now to FIG. 5, a low profile vented pump is designated generally by the numeral 100. The pump 100 is substantially the same as the vented pump 16 except that the pump base 24 provides for a truncated mounting ring 104. The vented pump 100 is also differentiated in that a vent stem 106 extends from the pump base 24 and surrounds the portions of the vent hole 44 and the vent 22 that feed the retention cavity 35. This configuration provides for the material to enter the inlet through the stem 106 and also allows for the vacuum within the container to be released through the stem. This low profile configuration of the vented pump allows for attachment to smaller refill containers which are more suitable for low-profile environments. In particular, the low profile configuration may be used when a dispense point of the refill container is positioned away or offset from the pump.

Figure 6:
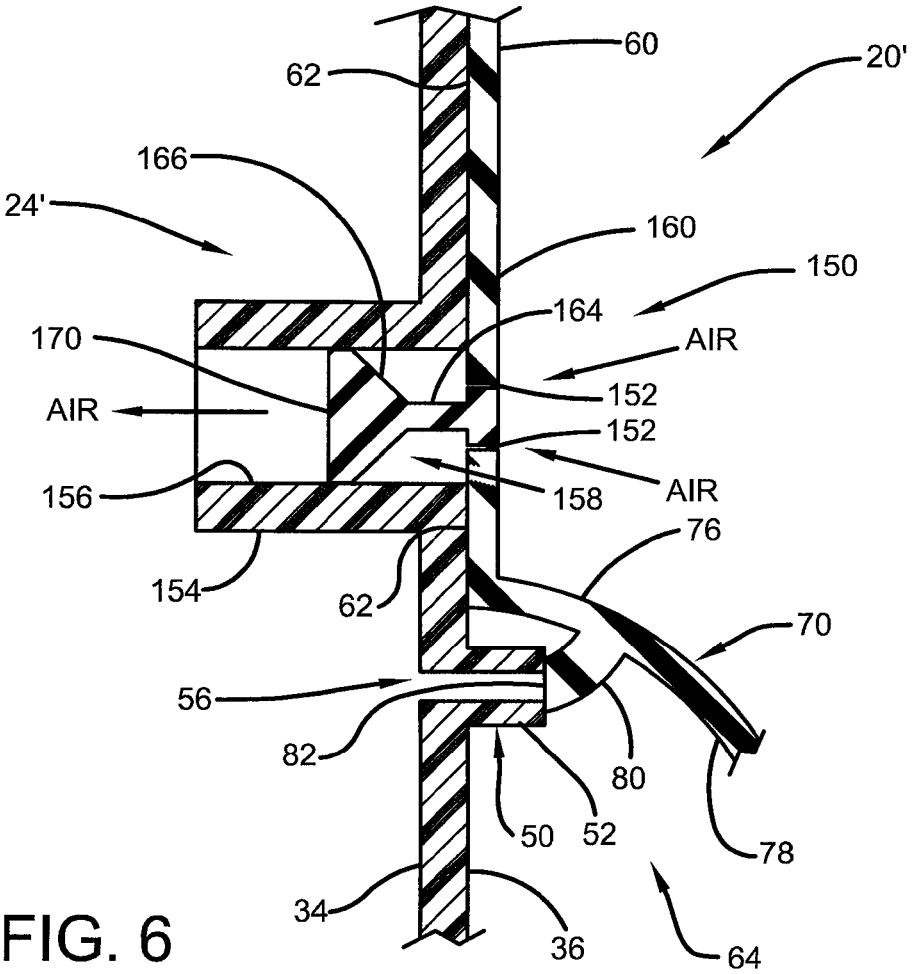
FIG. 6 is an alternative vented pump in cross-section according to the concepts of the present invention.

Referring now to FIG. 6, it can be seen that an alternative vented pump is designated generally by the numeral 150. This embodiment is substantially similar to the vented pump 20 except that the vent is radially positioned away from the dome portion 70. This embodiment employs the same identifying numerals where the structure is the same, but different numbering is used for the distinguishable components.

The vented pump 150 provides for at least one vent opening 152. Skilled artisans will appreciate that the vent opening 152 is positioned radially outside the seal periphery 60 of the dome portion 70 but within the mounting ring 26. Surrounding the vent opening 152 is a circular inlet wall 154 which extends from the container surface 34 into the cavity 35. The inlet wall 154 provides an inner wall surface 156 which forms an inlet cavity 158. Received within the inlet cavity 158 is a conical check valve 160. The vent opening or openings 152 are aligned with the inlet cavity 158.

The conical check valve 160 includes a shaft 164 that extends from an underside of the pump dome 20' in an area between the seal connection 62 and the dome portion 70. The check valve 160 provides an air-tight seal within the inlet cavity 158. Extending from an end of the shaft 164 is a conical wing 166. The conical wing provides for a tip 170 that engages or is positioned adjacent an entirety of the inner wall surface 156. In this embodiment, the seal connection 62 may also surround the at least one vent opening 152 to preclude inadvertent entry of air into the inlet cavity 158.

In operation, the vented pump 150 operates in much the same way as the pump of the previously described embodiment. As the pump dome 20' is depressed, it pushes the material that is contained within the dome cavity 64 out the pump outlet 23 and the tab 80 is deflected so as to allow for material from the container to enter through the inlet 56 as the dome returns to its normal position. At such time as a sufficient vacuum force is generated within the pump and refill container, air is drawn in past the conical check valve 160. This occurs by allowing the ambient air to enter through the vent opening 152 while also slightly collapsing the wing 156 such that the tip 170 temporarily disengages from at least a portion of the inner wall surface 156. At such time as when the vacuum force is adequately relieved, the conical check valve relaxes so as to re-form the appropriate seal and the pump continues to operate as in the previous embodiment.

Both embodiments are advantageous in that the vacuum force is sufficient to allow for ambient air to enter into the retention cavity, which is part of the vented pump, and into the container, thus releasing the vacuum and allowing fluid to enter the pump 20. The configuration disclosed is advantageous in that the embodiments only require two different pieces—the pump housing and the pump dome—to be secured to one another. Both constructions are much simpler to manufacture than the prior art constructions, as the number of parts are significantly reduced along with the assembly time. Indeed, in both embodiments, the vent and the dome of the pump dome are constructed as a single piece and from the same material. The disclosed configurations are also advantageous in that the pump assembly may be utilized with a rigid container which may allow for further cost reduction of the overall assembly.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of the true scope and breadth of the invention, reference should be made to the following claims.

I claim:

1. A vented pump, comprising:

a pump housing having a fluid retention cavity, said pump housing having a fluid inlet therethrough and at least one vent opening therethrough; and a pump dome secured to said pump housing and together forming a dome cavity, wherein the at least one vent opening opens into the dome cavity, wherein movement of said pump dome allows material from said fluid retention cavity to enter said dome cavity through said fluid inlet, and selectively allows ambient air to enter said fluid retention cavity through said at least one vent opening.

2. The vented pump according to claim 1, further comprising:

a dome tab extending from said pump dome and covering said fluid inlet in a resting position, wherein deflection of said pump dome moves said dome tab to allow entry of fluid into said dome cavity.

3. The vented pump according to claim 2, further comprising:

a dome vent extending from said pump dome into said vent opening, said dome vent selectively allowing ambient air to enter said fluid retention cavity.

4. The vented pump according to claim 2, further comprising:

a check valve associated with said vent opening, said check valve selectively allowing ambient air to enter said fluid retention cavity.

5. The vented pump according to claim 2, further comprising:

a mounting ring extending from said pump housing in a direction opposite said pump dome.

6. The vented pump according to claim 5, further comprising:

a sealing ring extending from said pump housing in said direction opposite said pump dome.

7. The vented pump according to claim 1, wherein said pump dome is hemispherical and said pump dome and said pump housing have a pump outlet, said at least one vent opening positioned at least 30° away from said pump outlet.

8. The vented pump according to claim 1, further comprising:

a reed valve extending from said pump dome, said reed valve having a valve opening through which the fluid is dispensed.

9. A vented pump used with a container, comprising:

a fluid container; and a vented pump coupled to said fluid container, said vented pump comprising:

a pump housing having a fluid retention cavity contiguous with said fluid container through a fluid inlet, said pump housing having at least one vent opening therethrough;

a valve located proximate the vent opening;

the valve configured to open when a sufficient vacuum pressure builds up in the fluid container and to close when the vacuum pressure drops, and a pump dome secured to said pump housing so as to form a pump cavity, wherein movement of said pump domes draws fluid in from said fluid container through said fluid retention cavity via said fluid inlet and selectively allows ambient air into said fluid retention cavity through said at last one vent opening when the vacuum pressure in the container causes the valve to open.

10. The vented pump used with a container, according to claim 9, wherein said container is non-collapsible.

11. The vented pump used with a container, according to claim 10, wherein said vented pump further comprises:

a port extending from said pump housing into said pump cavity so as to form said fluid inlet; and a dome tab extending from said pump dome and forming a fluid-tight seal on said port until said pump dome is actuated.

12. The vented pump used with a container, according to claim 10, wherein said pump dome has a dome vent providing said vent opening, said dome vent having a sleeve that extends into said fluid retention cavity, said sleeve having said vent opening which is normally closed but which opens upon generation of a suitable vacuum force within said non-collapsible container.

13. The vented pump used with a container, according to claim 10, wherein said pump dome has an outer periphery and a vent opening positioned radially away from said outer periphery, further comprising a check valve extending from said outer periphery into said fluid retention cavity.

14. A vented pump used with a container, comprising:

a fluid container; and a vented pump coupled to said fluid container, said vented pump comprising:

a pump housing having a fluid retention cavity contiguous with said fluid container through a fluid inlet, said pump housing having at least one vent opening therethrough; and a pump dome secured to said pump housing so as to form a pump cavity, wherein movement of said pump domes draws fluid in from said fluid container through said fluid retention cavity via said fluid inlet and selectively allows ambient air into said fluid retention cavity through said at last one vent opening, wherein said pump dome has an outer periphery and a vent opening positioned radially away from said outer periphery, further comprising a check valve extending from said outer periphery into said fluid retention cavity a pump inlet extending from said pump housing into said fluid retention cavity, said pump inlet forming an inlet cavity aligned with said at least one vent opening, wherein said check valve seals said inlet cavity until vacuum forces are sufficient to draw in ambient air through aid at least one vent opening.

15. The vented pump of claim 1 further comprising a vent valve.

16. The vented pump of claim 15, wherein the vent valve is a slit valve.

17. The vented pump of claim 9 further comprising a vent valve.

18. The vented pump of claim 17, wherein the vent valve is a slit valve.

19. The vented pump of claim 9 further comprising an outlet valve.

20. The vented pump of claim 19 wherein the outlet valve is a reed valve.

* * * * *